US005091725A

United States Patent [19]

Gard

[11] Patent Number: 5,091,725

[45] Date of Patent: Feb. 25, 1992

[54] WELL LOGGING TOOL AND SYSTEM HAVING A SWITCHED MODE POWER AMPLIFIER

[75] Inventor: Michael F. Gard, New Berlin, Wis.

[73] Assignee: Atlantic Richfield Company, Los Angeles, Calif.

[21] Appl. No.: 706,543

[22] Filed: May 23, 1991

Related U.S. Application Data

[63] Continuation of Ser. No. 396,120, Aug. 18, 1989, abandoned.

[51] Int. Cl.[5] ..... G01V 1/40

[52] U.S. Cl. ..... 340/854.1; 340/857.1; 375/22; 324/369

[58] Field of Search ..... 340/854, 857; 375/22; 324/369, 356; 364/422

[56] References Cited

U.S. PATENT DOCUMENTS

| | | | |
|---|---|---|---|
| 4,628,275 | 12/1986 | Skipper et al. | 330/10 |
| 4,691,203 | 9/1987 | Rubin | 340/856 |
| 4,837,518 | 6/1989 | Gard et al. | 324/368 |
| 4,839,644 | 6/1989 | Serfinya et al. | 340/854 |
| 4,891,641 | 1/1990 | Gard et al. | 340/857 |
| 4,902,981 | 2/1990 | Gard et al. | 330/9 |
| 4,906,928 | 3/1990 | Gard | 324/240 |

*Primary Examiner*—Nelson Moskowitz

*Attorney, Agent, or Firm*—Vinson & Elkins

[57] ABSTRACT

A logging tool (22) for use in measuring underground parameters and transmitting electromagnetic energy (38) through the lithosphere (16) is disclosed. The logging tool (22) includes a CPU-controlled data acquisition circuit (44–56) to measure down-hole parameters. A modulator (58) generates an output signal modulated to describe the measured parameters, and the modulator drives a power amplifier (66). In the power amplifier (66), DC current from a positive terminal of a battery (30) is routed through a semiconductor switching device (74) and an inductor (78) to an electrode (34), which directly contacts a well casing (18). A ground terminal (80) couples to a negative terminal of the battery (30) and another electrode (36), which also directly contacts the well casing (18). A diode (76) couples between the switch (74) and inductor (78) at a cathode and ground (80) at an anode. A capacitor (82) couples between the electrodes (34–36). A pulse width modulator (70) controls switching of the switch (74) in response to an oscillator signal and an error signal. The error signal is supplied from an error amplifier (68) which compares the modulator output signal to the transmitted output signal. Accordingly, a feedback loop controls the duty cycle of a constant frequency switching signal applied to the switch (74) so that the transmitted signal tracks the modulator output signal.

30 Claims, 2 Drawing Sheets

WELL LOGGING TOOL AND SYSTEM HAVING A SWITCHED MODE POWER AMPLIFIER

The present application is a continuation of copending application Ser. No. 396,120, filed Aug. 18, 1989, now abandoned.

TECHNICAL FIELD OF THE INVENTION

The present invention relates generally to power amplifiers which adapt a modulated input signal for application to a transmission channel. More specifically, the present invention relates to such power amplifiers which are specifically adapted for oil well, down-hole telemetry applications that electromagnetically transmit information from an underground location through a well casing and the lithosphere.

BACKGROUND OF THE INVENTION

Many oil field applications now gather or would benefit from the gathering of information from the bottom of a well and the transmission of such information to the surface As well exploration, drilling, and other activities become more sophisticated, the demands for such down-hole information increase. The continually increasing sophistication and capabilities of electronics makes it possible to gather information of great precision and importance. Unfortunately, the transmission of data from down-hole to the surface has continuously been a major obstacle in obtaining such information.

In many cases a drill string is removed from a well, a logging tool is lowered into the well by a logging cable, and information is transferred between the logging tool and the surface by electrical conductors in the logging cable. While this surface-to-logging tool electrical cable permits the collection of high quality information from the well, it suffers some serious drawbacks. For example, this procedure is often undertaken only at extreme expense, loss of time, and loss of production. If it is employed in an open-hole situation there is always the danger of damage to the hole or loss of the tool. Moreover, it simply cannot be used to capture real-time data while drilling, which the industry describes as measurement while drilling (MWD). Furthermore, it cannot be used during well stimulation or fracturing where the logging cable would be damaged from fluids and fluid-conveyed particulate matter, or where it would represent an intolerable restriction of the fluid path.

Accordingly, alternate data transmission techniques have been developed to transmit information. Such procedures include modulating mud pressure, attaching or embedding insulated electrical conductors in a drill string, transmitting modulated acoustic waves, and transmitting modulated electromagnetic waves. While all of these techniques have been successfully employed in particular situations, none have proven practical for a wide variety of applications.

Well stimulation and fracturing operations are typically performed in cased wells where metal casing has been cemented in place to isolate production fluids from surrounding formation fluids. In these operations, mud pressure telemetry often fails to work because it is performed through tubing, which often requires use of packers, and is subject to interference caused by pressure pulsations from surface pumps. Likewise, the attaching or embedding of insulated electrical conductors in a drill string fails to work reliably because of poor electrical connections between drill string sections and cable wear from fluids and particles transported by the fluids. The transmission of acoustic waves suffers from a poor signal-to-noise ratio. Thus, the transmission of acoustic waves fails to work during acoustically noisy operations.

Moreover, conventional techniques for transmitting electromagnetic (EM) waves generally have not been successful in case-d wells due to the extremely low resistance and high magnetic permeability of the steels used in oil field casing. Conventional down-hole EM transmitters often utilize a large transformer for coupling a modulated electrical signal to the earth's bulk (lithosphere), for impedance matching, and for current amplification. While such a conventional EM transmitter may be configured with a minimally dimensioned transformer and centralizer-type electrodes to couple a high current, low voltage output signal into a well casing, the resulting output signal exhibits a voltage too low to be useful in all but the most shallow wells. This limited signal voltage results from the low casing resistance, undesirably high transformer impedance, and power amplifier inefficiencies. Moreover, such a conventional EM transmitter is powered from batteries, which demonstrate an undesirably short life when high-power output signals are transmitted though the inefficient power amplifier. Furthermore, such a conventional EM transmitter exhibits an undesirably low reliability because of excessive heat build-up in the high power devices employed by the inefficient power amplifier.

In order for the transmission of EM waves to effectively convey information from a logging tool positioned in a well to the surface, increased current must be injected into the casing so that a larger signal voltage will result. However, increased current from the coupling transformer requires a larger transformer design, and larger transformers typically cannot be accommodated in a well logging tool. On the other hand, prior art devices have been used to directly couple electrical currents into a well casing without using a transformer. However, such devices tend to utilize linear power amplifiers to inject small currents. Although often highly accurate, linear power amplifiers are particularly inefficient. Consequently, such amplifiers would suffer seriously degraded reliability and battery life if adapted to a high-power EM transmission application.

SUMMARY OF THE INVENTION

Accordingly, it is an advantage of the present invention that a switched mode power amplifier, which is particularly efficient, is provided.

Another advantage is that the present invention provides a down-hole electromagnetic transmitter which exhibits improved battery life and reliability.

Yet another advantage of the present invention is that an apparatus which transmits modulated electromagnetic waves from an underground location through a well casing is provided.

Still another advantage is that the present invention provides a method for coupling a modulation signal to a well casing for the transmission of electromagnetic energy.

The above and other advantages of the present invention are carried out in one form by a power amplifier which responds to an information modulated electrical signal and which generates a transmission signal for application to a transmission channel. The power amplifier includes a switching device which receives a DC power signal and switches in response to a switching signal applied at a control input. A current steering device, which conducts current in one direction more easily than in another, couples to an output side of the switching device. A first node of an energy storage device couples to the output side of the switching device, and a second node of the energy storage device couples to the transmission channel. A feedback-actuated controller has a first input which couples to the second node of the energy storage device. In addition, a second node receives the information modulated electrical signal, and an output supplies the switching signal. The controller defines the duration for which the switching device is activated so that the voltage exhibited by the transmission signal corresponds to the information modulated electrical signal.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

DETAILED DESCRIPTION OF THE PREFERRED EMBODIMENT

Figure 1:
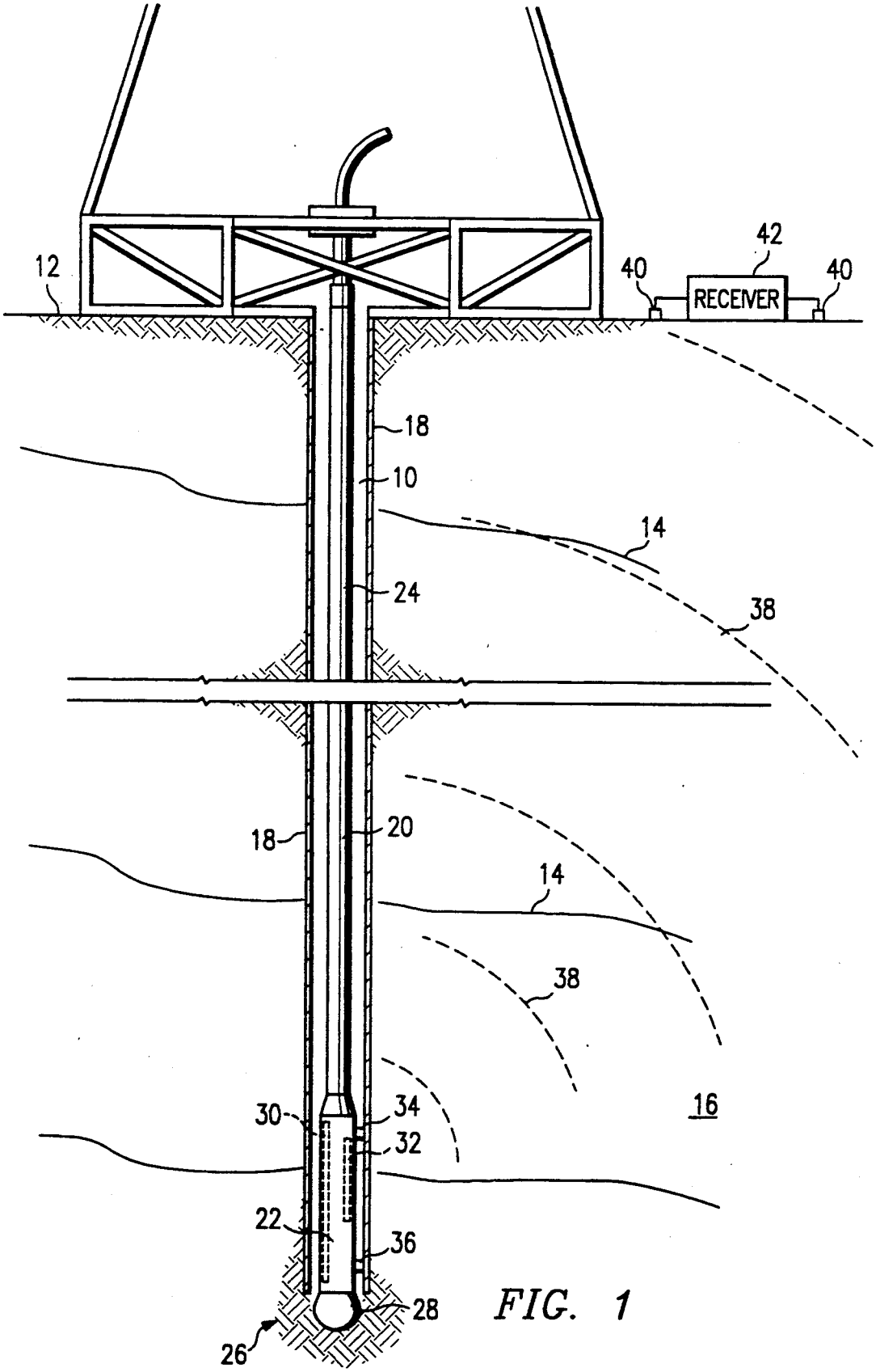
FIG. 1 shows a cross-sectional view of an oil well employing a logging tool in accordance with the present invention.

FIG. 1 depicts an oil well 10 which extends from the surface 12 of the earth underground through various strata 14 of the lithosphere 16. A well casing 18, which is formed from a low resistance material with high magnetic permeability, as is conventional for use in connection with oil wells, surrounds well 10. A subsurface assembly 20 resides within well 10 and casing 18. Assembly 20 extends downward from surface 12 and includes a logging tool 22, which has been lowered into well 10 using a drill string or cable 24 to a desired depth. In addition, a down-hole end 26 of assembly 20 may optionally include an operational tool 28, such as a drill bit or tool for performing non-drilling oil well operations.

The present invention contemplates the use of logging tool 22 in many different applications. If the application is measurement while drilling (MWD), logging tool 22 may remain attached drill string 24. However, in many operations encountered in well stimulations and fracturing, logging tool 22 is locked in place in well 10, and logging cable 24 is detached and removed from well 10 until it is time to retrieve logging tool 22.

Logging tool 22 includes batteries 30, electrical circuits 32, a signal casing electrode 34, and a reference casing electrode 36. In the preferred embodiment, logging tool 22 receives no electrical power from surface 12. Thus, batteries 30 provide all the electrical power utilized by electrical circuits 32. Electrodes 34 and 36 physically contact and electrically DC couple circuits 32 of logging tool 22 to well casing 18. In the preferred embodiment, casing electrodes 34 and 36 are conventional in design, and are spaced many feet apart, preferably in the 10–40 foot range.

Logging tool 22 couples electromagnetic energy, as indicated by field lines 38, through electrodes 34 and 36, through casing 18, and into lithosphere 16. Electromagnetic energy 38 exhibits an extremely low or ultra low frequency, preferably in the 1–30 Hz range. Such low frequency advantageously experiences reduced attenuation while propagating through lithosphere 16 when compared to the behavior of higher frequency electromagnetic energy. Moreover, electrical circuits 32 encode electromagnetic energy 38, using conventional modulation techniques, to convey information describing one or more of various parameters measured by logging tool 22.

After propagating through lithosphere 16 to surface 12, an electrode set or other pick-up device 40 located at surface 12 receives electromagnetic energy 38. Electrode set 40 couples to a receiver 42, which amplifies, demodulates, decodes, and displays the information or passes the information to other data processing equipment (not shown). Consequently, the information measured by logging tool 22 within well 10 is transmitted to surface 12 using electromagnetic techniques, without using logging cable 24 and without receiving electrical power from surface 12.

Figure 2:
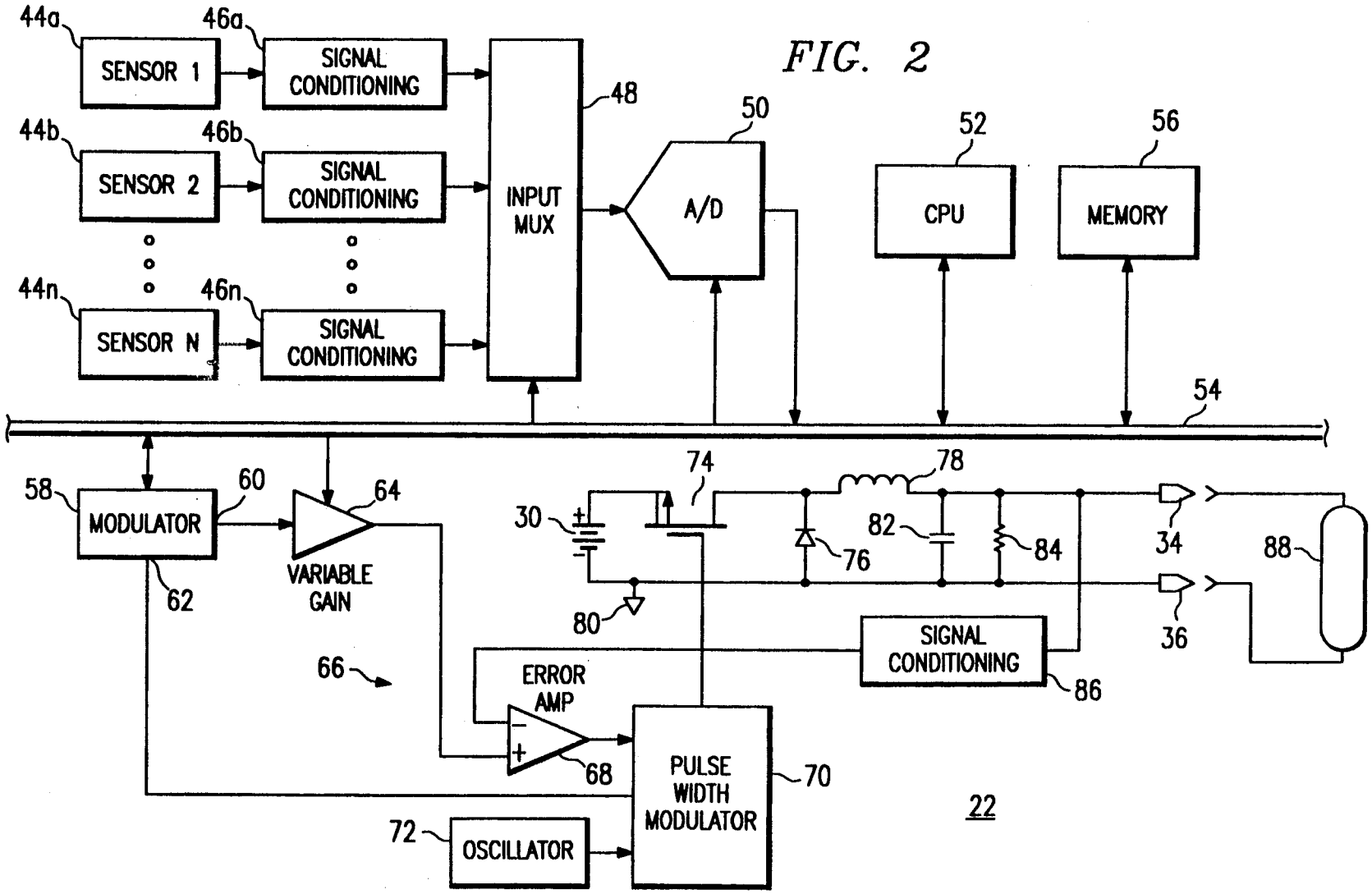
FIG. 2 shows a block diagram of the logging tool of the present invention.

FIG. 2 shows a block diagram of a preferred embodiment of logging tool 22. Specifically, logging tool 22 includes a plurality of sensors 44*a*, 44*b*, . . . , 44*n*, collectively referred to as sensors 44. Preferably, logging tool 22 includes one of sensors 44 for each parameter measured by logging tool 22. Such parameters may advantageously include, but are not limited to, pressure, temperature, salinity, well direction, resistivity, sonic density, porosity, battery voltage, and the like. Each of sensors 44 is physically located, oriented, and configured, using conventional techniques to generate an electrical output signal responsive to the measured parameter, which, in the embodiment depicted in FIG. 2, is assumed to be an analog signal.

An output of each of sensors 44 which supplies the respective analog output signal couples to an input of a corresponding signal conditioning circuit 46*a*, 46*b*, . . . , 46*n*, collectively referred to as signal conditioning circuits 46. Signal conditioning circuits 46 filter, amplify, and otherwise process their respective analog signals using conventional data acquisition techniques. Outputs of each of signal conditioning circuits 46 couple to signal inputs of an analog multiplexer 48, and a signal output of analog multiplexer 48 couples to an analog input of an analog-to-digital (A/D) converter 50. Multiplexer 48 routes a selected one of the analog signals at its signal inputs to its signal output, and A/D converter 50 converts the selected analog signal into a digital signal.

A central processing unit (CPU) 52 generally controls the operation of logging tool 22. CPU 52 operates through a data, I/O, and control bus 54 to communicate with other components of logging tool 22. A memory 56, which couples to bus 54, serves as one of such components. Memory 56 contains programming instructions, which define the various tasks and sequences performed by CPU 52, and storage registers, which may temporarily retain data descriptive of the parameters measured by sensors 44.

Bus 54 additionally couples to a selection input of multiplexer 48 and to a control input of A/D converter 50. Consequently, CPU 52 specifies parameters for conversion by A/D converter 50 by selecting a channel through multiplexer 48, and CPU 52 provides a control signal to A/D converter 50 which initiates such conversions. Moreover, a data port of A/D converter 50 couples to bus 54. Consequently, when such conversions are complete, digital data descriptive of the parameter converted by A/D converter 50 are transferred through this data port to CPU 52 for further processing.

In addition, CPU 52 controls the operation of a modulator 58, which couples to bus 54. Modulator 58 accepts digital data from CPU 52 and supplies an analog information signal at a modulator output 60. Modulator 58 modulates any one of several possible carrier signals in response to the digital data received from CPU 52. Thus, modulator 58 may employ the use of an oscillator (not shown) in generating the modulation signal supplied at modulator output 60. Although the present invention contemplates the use of any conventional modulation technique by modulator 58, frequency and phase modulation techniques are believed to be most effective in communicating electromagnetic energy 38 (see FIG. 1) through lithosphere 16. Preferably, modulator 58 produces a quadrature phase shift keying (QPSK) signal so that logging tool 22 may remain as compatible as possible with existing equipment and techniques. Optionally, modulator 58 may generate a polarity signal at a polarity output 62. As discussed above, the modulation signal exhibits a frequency in the extremely low or ultra low frequency range, preferably around 1–30 Hz.

Modulator output 60 couples to an input of a variable gain device 64. Moreover, CPU 52 couples to a control input of device 64 through bus 54. Depending on design details, either a variable gain amplifier or an attenuator may serve as device 64. Regardless of whether device 64 provides gain or attenuation, an output of device 64 provides the modulation signal at an amplitude controlled by CPU 52. As discussed further below, this amplitude corresponds to a signal level of a transmitted signal. Thus, CPU 52 may increase transmitted signal level to improve signal reception from deep wells, or reduce transmitted signal level in more shallow wells to extend battery life.

The output of device 64 couples to an input of a power amplifier 66 of logging tool 22. Specifically, the output of device 64 couples to a non-inverting input of an error amplifier 68. An output of error amplifier 68 couples to a reference input of a pulse width modulator (PWM) 70, and an oscillator 72 has an output which couples to an oscillator input of PWM 70. Polarity output 62 of modulator 58 may optionally couple to a polarity input of PWM 70. In the preferred embodiment, PWM 70 is selected from one of many commercially available integrated pulse width modulator circuits supplied by semiconductor manufacturers. An output of PWM 70 couples to a control port or gate of a MOSFET semiconductor switch 74. A first signal port, or source, of switch 74 couples to a positive terminal of batteries 30, and a second signal port, or drain, of switch 74 couples to a first node of a current steering device, such as a cathode of a diode 76. In addition, the second signal port of switch 74 couples to a first node of an energy storage device, such as an inductor 78.

A second node of inductor 78 DC couples to signal casing electrode 34, discussed above in connection with FIG. 1. A negative terminal of batteries 30 and an anode of diode 76 couple to a terminal adapted to receive a common potential, such as ground 80. An energy storage device, such as capacitor 82, and a by-pass resistor 84 couple between the second node of inductor 78 and ground 80. Furthermore, reference casing electrode 36, discussed above in connection with FIG. 1, couples to ground terminal 80. In addition, signal casing electrode 34 couples to an input of a signal conditioning circuit 86, and an output of signal conditioning circuit 86 couples to an inverting input of error amplifier 68. Signal conditioning circuit 86 may be implemented using an amplifier, attenuator, filter, or a combination of such functions. However, in the preferred embodiment signal conditioning circuit 86 is configured to impart substantially zero degrees of phase shift on the modulation signal.

The output of PWM 70 supplies a control signal that exhibits one of two possible states at any given point in time to the control input of switch 74. In response to the state of the control signal, switch 74 activates or switches ON, thereby providing a low impedance path between the first and second switch signal ports, and deactivates or switches OFF, thereby providing a high impedance path between the first and second switch signal ports.

Generally speaking, inductor 78 stores energy so that it tends to stabilize current flowing therethrough. On the other hand, capacitor 82 stores energy so that it tends to stabilize voltage appearing thereacross. Thus, the instant switch 74 switches ON or OFF, the amount of current flowing through inductor 78 does not significantly change from the amount of current flowing prior to such switching of switch 74, and the voltage across electrodes 34 and 36 remains substantially constant. Diode 76 is oriented within power amplifier 66 so that current from batteries 30 is isolated from ground 80 when switch 74 is switched ON. However, in order to meet the current flow demands of inductor 78, the orientation of diode 76 permits current flow from ground 80 to inductor 78 to form a circuit when switch 74 turns OFF.

Batteries 30 provide DC current at a voltage which is greater than the peak output signal voltage desired across electrodes 34 and 36. At this desired voltage, while switch 74 is switched ON, inductor 78 supplies an increasing amount of current to electrode 34 and to a load 88 provided by well casing 18 (see FIG. 1). At the same time, capacitor 82 supplies a decreasing amount of current to electrode 34. Consequently, when switch 74 is first switched ON, the voltage across electrodes 34 and 36 is decreasing because inductor 78 cannot supply a sufficient amount of current to meet the current demands of load 88, and the charge stored in capacitor 82 supplies a portion of this load current. Eventually, the current flowing through inductor 78 increases until inductor 78 supplies all the current demands of load 88. After this point in time, the voltage across electrodes 34 and 36 increases as the further increasing current supplied by inductor 78 charges capacitor 82. This voltage continues to increase until switch 74 switches OFF.

When switch 74 is switched OFF, inductor 78 supplies a decreasing amount of current to electrode 34, while capacitor 82 supplies an increasing amount of current. Consequently, when switch 74 is first switched OFF, the voltage across electrodes 34 and 36 increases until current flow through inductor 78 decreases to the point where inductor 78 supplies only enough current to meet the demands of load 88. After this point in time, the voltage across electrodes 34 and 36 decreases as the decreased current flow through inductor 78 forces capacitor 82 to lose its charge by supplying current to load 88. This voltage continues to decrease until switch 74 switches ON.

Thus, the average of the voltage presented to load 88 is maintained at the desired voltage by controlling the switching of switch 74. Specifically, PWM 70 controls the ON-time and OFF-time durations for switch 74 to maintain the desired average voltage across electrodes 34 and 36. Under the influence of an oscillating signal provided by oscillator 72, PWM 70 outputs a constant frequency, variable duty cycle control signal. In the preferred embodiment, the oscillating signal exhibits a frequency many times greater than the maximum frequency obtainable by the modulation signal. Thus, inductor 78 may be designed to operate at frequencies determined by the oscillating signal rather than at the modulation frequency. As a result, inductor 78 is much smaller than transformers utilized by prior art devices to couple electromagnetic energy to well casings.

PWM 70 defines the duty cycle of the control signal to manipulate the ON-time and OFF-time durations for switch 74. PWM 70 controls this duty cycle in response to an error signal supplied by error amplifier 68. Error amplifier 68 compares the actual output signal across electrodes 34 and 36 against a desired output signal, represented by the output of variable gain element 64. The error signal continuously exhibits a polarity and amplitude which instructs PWM 70 whether to increase or decrease the control signal's duty cycle and establishes the quantity of increase or decrease necessary to force the actual output signal to equal the desired output signal. Thus, power amplifier 66 utilizes feedback to maintain an output voltage which correspondingly tracks the modulation signal.

Voltage distortions of the output signal away from the average output signal are substantially caused by the switching of switch 74. Such distortions occur at a frequency many times greater than the maximum modulation signal frequency. Thus, such distortions have substantially no effect on the ability of logging tool 22 to communicate information through lithosphere 16 (see FIG. 1). Moreover, signal conditioning circuit 86 includes appropriate amplification, inversion, or filtering, as is conventional in feedback loops, so that the output signal produced across electrodes 34 and 36 tracks the modulation signal applied to error amplifier 68 with a desired response. Preferably, the overall feedback loop filtering is designed so that the feedback loop responds much more quickly than the maximum frequency modulation signal.

In summary, the present invention provides a particularly efficient power amplifier 66 for use in transmitting modulated electromagnetic waves 38 (see FIG. 1) from an underground location through a well casing 18 and the lithosphere 16. Switch 74 switches at a relatively high frequency relative to a modulation signal and exhibits only an ON or OFF state. During the ON state, switch 74 experiences very little voltage drop, and very little power loss results. During the OFF state, switch 74 experiences very little current leakage, and very little power loss results. The remaining components likewise consume very little power. In effect, the present invention removes energy directly from batteries 30 in short, highly efficient bursts. Proper attention to design details will result in very small power losses in the electronics of the present invention. Due to the efficiency of power amplifier 66, the present invention DC couples a relatively high current signal into well casing 18 without excessively consuming battery power and without excessively generating heat build-up which reduces component reliability.

The present invention has been described above with reference to a preferred embodiment. However, those skilled in the art will recognize that changes and modifications may be made in this preferred embodiment without departing from the scope of the present invention. For example, the present invention may be adapted for use in applications other than the oil well application described herein. In addition, two complementary power amplifiers 66 (see FIG. 2) may be used to generate a truly bipolar output signal. Moreover, due to the low frequencies utilized in the preferred embodiment, some of the functions described herein, such as that of modulator 58, may be performed directly by CPU 52. Furthermore, nothing prevents the present invention from being incorporated into a transceiver which additionally receives data transmitted from surface 12 (see FIG. 1). These and other changes and modifications which are obvious to those skilled in the art are intended to be included within the scope of the present invention.

What is claimed is:

1. A power amplifier for responding to an information modulated electrical signal to generate a transmission signal for application to a transmission channel, said amplifier comprising:

a switching device having a first signal port adapted to receive a DC power source, having a control input, and having a second signal port;

a current steering device coupled to said second signal port of said switching device, said current steering device conducting current in a first direction therethrough more easily than in a second direction therethrough;

an energy storage device having a first node coupled to said second signal port of said switching device and having a second node for coupling to said transmission channel; and a feedback-actuated controller having a first input coupled to said second node of said energy storage device, a second input adapted to receive said information modulated electrical signal, and an output coupled to said control input of said switching device, said controller defining a duration for which said switching device is activated so that said transmission signal corresponds to said information modulated electrical signal.

2. A power amplifier as claimed in claim 1 additionally comprising a second energy storage device having a first node coupled to said second node of said energy storage device and having a second node coupled to said current steering device.

3. A power amplifier as claimed in claim 2 wherein said second energy storage device comprises a capacitor.

4. A power amplifier as claimed in claim 1 additionally comprising a terminal for coupling to said transmission channel, said terminal additionally being coupled to said current steering device.

5. A power amplifier as claimed in claim 4 wherein said transmission channel is a well casing, and said power amplifier additionally comprises a casing electrode which is DC coupled to said terminal.

6. A power amplifier as claimed in claim 1 wherein said controller additionally has a third input, and said power amplifier additionally comprises an oscillator having an output coupled to said controller third input, said oscillator cooperating with said controller to define a substantially constant frequency at which said switching device activates and deactivates.

7. A power amplifier as claimed in claim 6 wherein:

said information modulated electrical signal exhibits a predetermined frequency; and said oscillator exhibits a frequency greater than said predetermined frequency.

8. A power amplifier as claimed in claim 6 wherein said feedback-actuated controller comprises:

an error amplifier having inverting and non-inverting inputs and an output, a first one of said inverting and non-inverting inputs being coupled to said second node of said energy storage device and a second one of said inverting and non-inverting inputs being adapted to receive said information modulated electrical signal; and a pulse width modulator circuit having a first input coupled to said error amplifier output and a second input coupled to said oscillator output, said pulse width modulator circuit generating a switching device control signal having a frequency substantially equivalent to a frequency of a signal supplied by said oscillator and having a duty cycle corresponding to an error signal provided by said error amplifier.

9. A power amplifier as claimed in claim 1 wherein said feedback-actuated controller comprises a comparison circuit having inverting and non-inverting inputs, a first one of said inverting and non-inverting inputs being coupled to said second node of said energy storage device and a second one of said inverting and non-inverting inputs being adapted to receive said information modulated electrical signal, said comparison circuit providing an error signal which selectably increases and decreases activation duration for said switching device.

10. A power amplifier as claimed in claim 1 wherein said transmission channel is a well casing, and said power amplifier additionally comprises a casing electrode DC coupled to said second node of said energy storage device.

11. A power amplifier as claimed in claim 1 wherein said current steering device comprises a diode.

12. A power amplifier as claimed in claim 1 wherein said energy storage device comprises an inductor.

13. A down-hole telemetry apparatus for electromagnetically transmitting information from an underground location through a well casing, said apparatus comprising:

a battery for electrically energizing said down-hole telemetry apparatus;

a parameter sensor for providing a parameter signal which characterizes said information;

a modulator coupled to said sensor for generating a modulation signal exhibiting characteristics which are responsive to said parameter signal;

a switching device having a first port coupled to said battery, having a control input, and having a second port;

a diode coupled to said second port of said switching device;

an inductor having a first node coupled to said second port of said switching device and having a second node;

a casing electrode DC coupled to said inductor second node, said casing electrode for electromagnetically transmitting said information to said well casing; and a feedback-actuated controller having a first input coupled to said inductor second node, a second input coupled to said modulator, and an output coupled to said control input of said switching device, said controller defining a duration for which said switching device is activated so that said casing electrode transmits a signal which corresponds to said modulation signal.

14. A down-hole telemetry apparatus as claimed in claim 13 additionally comprising a second casing electrode for coupling to said well casing, said second casing electrode being DC coupled to said diode.

15. A down-hole telemetry apparatus as claimed in claim 14 additionally comprising a capacitor coupled between said casing electrode and said second casing electrode.

16. A down-hole telemetry apparatus as claimed in claim 15 wherein said controller has a third input, and said apparatus additionally comprises an oscillator having an output coupled to said controller third input, said oscillator cooperating with said controller to define a substantially constant frequency at which said switching device activates and deactivates to optimize operating efficiency of said inductor.

17. A down-hole telemetry apparatus as claimed in claim 16 wherein:

said modulation signal exhibits a frequency which substantially remains less than a maximum frequency; and said oscillator exhibits a frequency greater than said maximum frequency.

18. A down-hole telemetry apparatus as claimed in claim 17 wherein said feedback-actuated controller comprises:

an error amplifier having inverting and non-inverting inputs and an output, a first one of said inverting and non-inverting inputs being coupled to said casing electrode and a second one of said inverting and non-inverting inputs being coupled to said modulator; and a pulse width modulator circuit having a first input coupled to said comparator output and a second input coupled to said oscillator output, said pulse width modulator circuit generating a switching device control signal having a frequency substantially equivalent to a frequency of a signal supplied by said oscillator and having a duty cycle corresponding to an error signal provided by said error amplifier.

19. A down-hole telemetry apparatus as claimed in claim 13 additionally comprising a variable gain circuit coupled between said modulator and said controller, said variable gain circuit operating to control amplitude of signals applied to said well casing.

20. A down-hole telemetry apparatus as claimed in claim 19 additionally comprising computing means, coupled between said parameter sensor and said modulator, for controlling the sensing of said information, for formatting of said parameter signal into digital data, and for supplying of said digital data to said modulator.

21. A method of coupling an electrical modulation signal produced at an underground location to a well casing for electromagnetic transmission therethrough, said method comprising the steps of:

switching DC battery current on and off in response to a control signal;

when said DC battery current is switched on, forming a circuit for said DC battery current through an inductor and said well casing so that a transmission signal is applied to said well casing and so that energy is stored in said inductor;

when said DC battery current is switched off, forming a circuit for current generated from energy stored in said inductor through said inductor, said well casing, and a diode to continue application of said transmission signal to said well casing;

sensing the voltage of said transmission signal applied at said well casing;

generating an error signal which corresponds to error between said electrical modulation signal and said transmission signal applied at said well casing;

continuously modulating said control signal to reduce said error signal.

22. A method as claimed in claim 21 wherein:

said switching step switches said DC battery current at a substantially constant frequency; and said modulating step varies a duty cycle parameter of said substantially constant frequency.

23. A method as claimed in claim 21 additionally comprising the step of coupling a capacitor across said well casing throughout said forming steps to stabilize said voltage of said transmission signal for said sensing step.

24. A well logging system, comprising:

an electrode for detecting electromagnetic energy propagated through the earth;

a receiver coupled to said electrode for decoding signal information from the energy detected by said electrode; and a downhole transmitter, comprising:

a sensor for detecting a downhole condition and for generating an electrical signal corresponding thereto;

a modulator circuit, for modulating said signal from said sensor;

a power source;

a first output electrode, for applying electromagnetic energy to the earth;

a switch, coupled between said power source and a switch node, said switch having a control input;

a diode, coupled between said switch node and said voltage;

an inductor, coupled between said switch node and said first output electrode; and a control circuit, having a first input coupled to said modulator circuit, having a second input coupled to said first output electrode, and having an output coupled to the control input of said switch, for controlling the coupling of the power source to the switch node in such a manner that the energy applied to the earth by said first output electrode corresponds to the signal generated by said sensor.

25. The system of claim 24, wherein said downhole transmitter further comprises:

a capacitor coupled between said first output electrode and said reference voltage.

26. The system of claim 24, further comprising:

a second ouput electrode, coupled to said reference voltage, for coupling said reference voltage to the earth.

27. The system of claim 24, wherein said control circuit comprises:

an error amplifier, having a first input coupled to the output of said modulator circuit, having a second input coupled to said first output electrode, and having an output, said error amplifier for presenting a difference signal at its output corresponding to the differential between signals received at its first and second inputs;

a periodic signal source, for generating a periodic signal; and a pulse width modulator circuit, having a first input coupled to the output of said error amplifier, having a second input coupled to said periodic signal source, and having an output coupled to the control input of said switch, for controlling said switch at the frequency of said periodic signal at a duty cycle corresponding to said difference signal.

28. The system of claim 27, wherein said periodic signal source comprises an oscillator.

29. The system of claim 27, wherein said periodic signal source is said modulator circuit.

30. The system of claim 24, wherein said first output electrode is for applying electromagnetic energy to conductive well casing.

* * * * *